United States Patent [19]

Gullichsen et al.

[11] 4,222,818

[45] Sep. 16, 1980

[54] METHOD FOR TREATMENT OF LIGNOCELLULOSIC MATERIAL WITH CHLORINE

[75] Inventors: Johan Gullichsen, Helsinki; Frey V. Sundman, Karhula, both of Finland

[73] Assignee: A. Ahlstroom Osakeyhtio, Noormarkku, Finland

[21] Appl. No.: 921,370

[22] Filed: Jul. 3, 1978

Related U.S. Application Data

[63] Continuation of Ser. No. 783,863, Apr. 1, 1977, abandoned.

[30] Foreign Application Priority Data

Apr. 28, 1976 [FI] Finland ..... 761171

[51] Int. Cl.[2] ..... D21C 9/12; D21C 9/14

[52] U.S. Cl. ..... 162/66; 162/67; 162/87; 162/88

[58] Field of Search ..... 162/67, 87, 88, 89, 162/57, 66

[56] References Cited

U.S. PATENT DOCUMENTS

| | | | |
|---|---|---|---|
| 2,046,551 | 7/1936 | Davies | 162/57 |
| 2,127,765 | 8/1938 | Casciani | 162/66 |
| 2,730,426 | 1/1956 | Becker | 162/66 |
| 2,772,318 | 11/1956 | Evans | 162/89 |
| 3,298,900 | 1/1967 | Laakso | 162/17 |
| 3,599,449 | 8/1971 | Richter | 162/89 |
| 3,652,388 | 3/1972 | Croon et al. | 162/66 |
| 3,802,958 | 4/1974 | Croon | 162/89 |
| 3,966,542 | 6/1976 | Oldshue | 162/57 |
| 4,093,506 | 6/1978 | Richter | 162/66 |

OTHER PUBLICATIONS

Gullichsen "Pilot Plant Application of the Displacement Bleaching Process", *TAPPI*, vol. 56, No. 11, Nov. 1973.

Rapson et al. "Dynamic Bleaching Continuous Movement of Pulp through Liquor Increases Bleaching", *TAPPI*, vol. 49, No. 8, 8-1966.

Gullichsen "Recent Achievements with the Displacement Bleaching Process", *TAPPI*, vol. 57, No. 10, 10-1974.

Gullichsen "High Density Chlorination", Preprint Version of a Paper Presented May 3-5 at Internatl. Bleaching Conference, Chicago.

*Primary Examiner*—S. Leon Bashore
*Assistant Examiner*—Steve Alvo
*Attorney, Agent, or Firm*—Bucknam and Archer

[57] ABSTRACT

A pulp containing lignocellulosic fibers is treated with chlorine in two steps. In the first step, chlorine in the amount of 0.6–0.9 grams per gram of lignin in the fibers, is mixed in the gaseous state into the pulp and in a second step the reaction products, which contain chlorinated lignin, are removed by displacing the liquid in the pulp with a chlorine solution, the amount of active chlorine in the solution in the second step being between 0.1 and 0.3 grams per gram of the lignin initially present in the pulp. In this manner 92% delignification is achieved without any intermediate washing between the two steps and with a total amount of chlorine between 0.7 and 1.2 grams per gram of lignin. The consistency of the pulp in both steps is the same and is between 6 and 12%.

8 Claims, 1 Drawing Figure

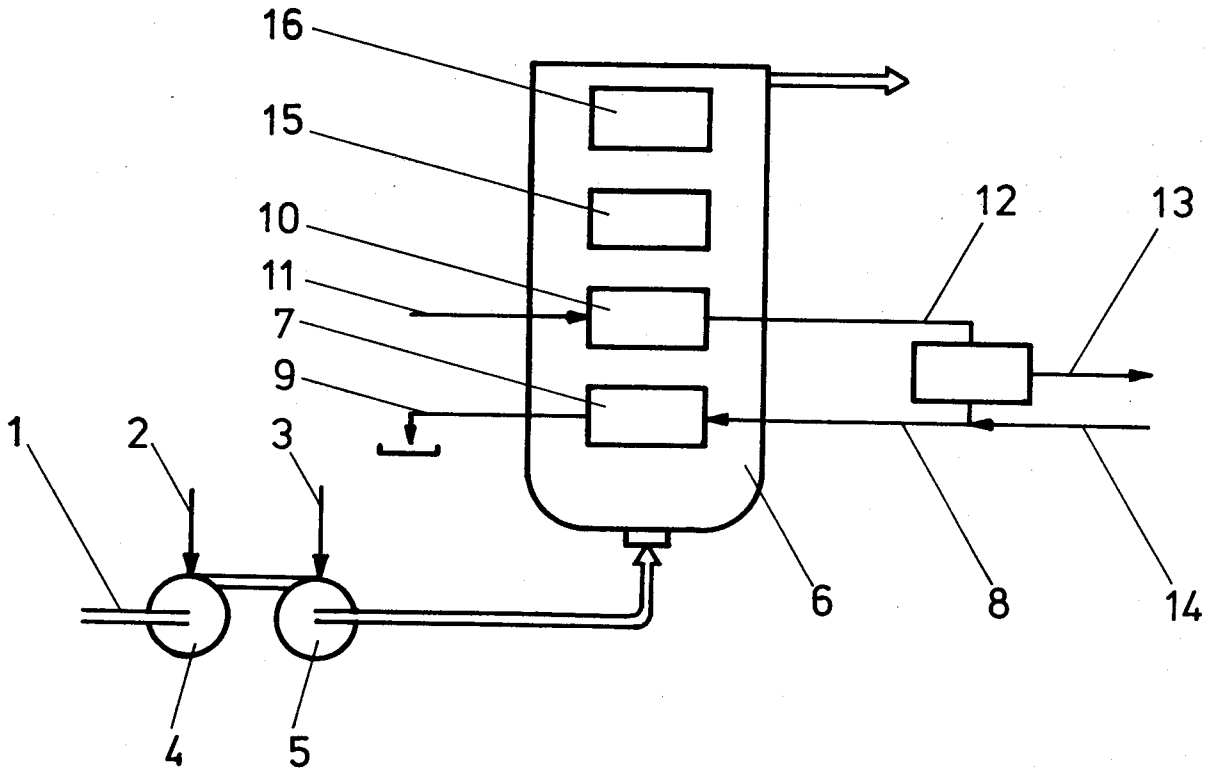
13
14
12
8
6
16
15
10
11
7
9
3
5
2
4
1

METHOD FOR TREATMENT OF LIGNOCELLULOSIC MATERIAL WITH CHLORINE

This is a continuation of application Ser. No. 783,863, filed Apr. 1, 1977, now abandoned.

BACKGROUND OF THE INVENTION

1. Field of Invention

This invention relates to a method of treating lignocellulosic material such as wood pulp with chlorine for the purpose of removing the lignin remaining after the cooking process.

The bleaching process usually begins with a chlorination step, in which the lignin is converted into a water- or alkali-soluble form, whereby it can easily be removed. Because the chlorine is an inexpensive chemical compared with other bleaching chemicals, one strives to remove as much lignin from the pulp with it as is possible taking into consideration the quality of the pulp. This reduces the amount of chemicals required in the subsequent bleaching steps.

2. Prior Art

Until now chlorination of the pulp has usually been performed at a consistency of 3–4% in a chlorination tower, where the chlorine which has been dissolved in water is mixed into the pulp and allowed to react for a period of one hour. Taking into consideration the strength of the pulp an addition of chlorine dioxide is advantageous.

Chlorination of the pulp can also be performed as a gas chlorination, whereby the pulp from which the water between the fibres has been removed so that it has a consistency of about 30% is treated in a gas flow. The reaction time is then very short.

The delignification is dependent on the chlorine charge up to a certain limit value, which is reached when the amount of chlorine is about 1.3 g/g of lignin. It is possible to dissolve about 80% of the lignin in the pulp by chlorination in one step. If the pulp is washed, whereby the chlorinated lignin is removed and a new chlorination is performed, about 50% of the residual lignin can be dissolved i.e. about 90% of the lignin remaining in the pulp after the cooking process can be removed.

The methods which have been used until now require two chlorination steps and one washing step and cause furthermore a high consumption of chlorine if a high degree of delignification by the treatment with chlorine is desired.

SUMMARY AND GENERAL DESCRIPTION OF THE INVENTION

It is the object of the invention to provide a chlorination method which comprises less stages of treatment than earlier known methods and by means of which a high degree of delignification can be achieved with a low consumption of chemicals.

According to the invention chlorine and possibly also chlorine dioxide in a gaseous state is mixed into the pulp and is permitted to react with the lignin in the fibres. The chlorinated lignin is removed from it by displacing it with a chlorine solution, whereafter the pulp is treated with for instance sodium hydroxide and chlorine dioxide in a manner known per se. The treatment is preferably performed at a pulp consistency of 6–12%, preferably 8–10%, whereby the chlorine and chlorine dioxide can be evenly dispersed in the pulp. The treatment is preferably performed at an elevated temperature, 30°–60° C., whereby the reaction is accelerated. The optimal temperature is 45° C. 0.7 . . . 1.2 g chlorine/g of lignin is needed, of which amount 0.7 . . . 1.2 g is used in the displacement step. The chlorination reaction requires only a few minutes time, but in practice a little more time is reserved for it, 5 . . . 15 min, usually about 10 min. The chlorine charge is however so small that all chlorine will be consumed without causing away deleterious side reaction even if the reaction time is prolonged.

One explanation for the very rapid and efficient chlorination in the first stage of the process is, that chlorine will dissolve continuously from the small gas bubbles into the liquid, and the liquid will stay basically saturated until the gas is practically exhausted.

According to the method earlier used in most cases, wherein the chlorination is performed at a consistency of about 3%, the amount of chlorine is so large and the reaction time so long that besides the actual chlorination reaction also chlorine consuming side reaction occures such as oxidation of the chlorinated lignin and partial degradiation of the cellulose molecules.

BRIEF DESCRIPTION OF THE DRAWING

The invention is described more in detail in the following with reference to the accompanying drawing, which shows a flow sheet of a bleaching process in which the new method is used.

DESCRIPTION OF A PREFERRED EMBODIMENT

In the drawing the reference numeral 1 denotes a pulp flow from a pulp washer after a digester. To it are fed chlorine dioxide 2 and chlorine 3 in a gaseous state, which are mixed into the pulp in mixers 4 and 5. Alternatively a mixture of chlorine and chlorine dioxide can be mixed into the pulp. The pulp flows then to a bleaching reactor 6, in the bottom part of which the chlorination mainly takes place. After an appropriate reaction time the reaction product, the chlorinated lignin, is removed by displacing it in the first displacement stage 7 of the diffusor with a chlorine solution 8. The displaced liquid 9 is removed from the reactor. In the following diffusor stage 10 the chlorinated lignin formed in the first stage and a possible residual chlorine is displaced with an alkaline solution 11. Lignin 13 is removed from the flow 12 from the diffusor and the liquid is returned to the system, whereby chlorine 14 and possibly also chlorine dioxide is added. The pulp is then finally bleached in a manner known per se in a diffusor stage 15 and washed in a diffusor stage 16.

The method according to the invention is further illustrated by the following example, in which the new method is compared with an earlier known.

| EXAMPLE | the known method | the new method |
|---|---|---|
| Lignin % | 4 | 4 |
| Chlorine charge (active Cl) % | 6 | 3.2 |
| Pulp consistency % | 3.5 | 9.0 |
| Temperature °C. | 20 | 50 |
| Reaction time min | 45 | 15 |
| Chlorine consumption % | 90 | 100 |
| Delignification % | 83 | 80 |
| Residual lignin % | 0.68 | 0.80 |
| Washing | + | – |
| Chlorine charge % | 1.6 | 1.2 |

-continued

| EXAMPLE | the known method | the new method |
|---|---|---|
| Reaction time min | 45 | 15 |
| Chlorine consumption % | 90 | 90 |
| Delignification % | 50 | 60 |
| Residual lignin % | 0.34 | 0.32 |
| Total chlorine charge % | 7.6 | 4.4 |
| Delignification % | 90 | 92 |

As is evident from the example a higher degree of delignification with lower chlorine consumption is achieved by the method in accordance with the invention.

What is claimed is:

1. A method of treating pulp containing lignocellulosic fibres with chlorine, to obtain 92% delignification consisting of a first step of mixing chlorine in a gaseous state into the pulp and permitting it to react with the lignin in the fibres to form reaction products containing chlorinated lignin and thereafter in a second step removing the reaction products containing chlorinated lignin by displacing the liquid in the pulp with a chlorine solution, the consistency of the pulp in both steps being the same and being 6–12%, the amount of chlorine gas which is mixed with the pulp in the first step being 0.6–1.0 g per gram of lignin, the amount of chlorine being used in the first step being consumed totally, and the reaction with chlorine gas taking place for a period of 5–15 minutes, the amount of active chlorine in the solution in the second step being 0.9 grams–0.3 g per gram of the lignin initially present in the pulp, the total amount of chlorine being 0.7–1.2 g per gram of lignin.

2. A method according to claim 1, wherein the treatment with chlorine in both steps is performed at a temperature of 30°–60° C.

3. The method according to claim 2 wherein the temperature in both steps is about 45° C.

4. A method according to claim 1, wherein the chlorine in the first step is evenly dispersed into the pulp in the form of small gas bubbles.

5. The method according to claim 1 wherein in the first step chlorine dioxide is also added to the pulp.

6. The method according to claim 5 wherein said chlorine solution in said second step also contains chlorine dioxide.

7. The method according to claim 1 wherein said chlorine solution in said second step also contains chlorine dioxide.

8. The method according to claim 1 wherein the pulp consistency is 8–10%.

* * * * *